United States Patent [19]

Shiozawa

[11] Patent Number: 4,572,498

[45] Date of Patent: Feb. 25, 1986

[54] SHEET FEEDER

[75] Inventor: Takao Shiozawa, Hachioji, Japan

[73] Assignee: Konishiroku Photo Industry Co., Ltd., Tokyo, Japan

[21] Appl. No.: 536,203

[22] Filed: Sep. 27, 1983

[30] Foreign Application Priority Data

Sep. 30, 1982 [JP] Japan ..... 57-171329

[51] Int. Cl.[4] ..... B65H 3/04

[52] U.S. Cl. ..... 271/34; 271/121; 271/164; 271/167

[58] Field of Search ..... 271/34, 121, 122, 124, 271/125, 162, 164, 167

[56] References Cited

U.S. PATENT DOCUMENTS 4,060,233 11/1977 Stange ..... 271/34 X
4,280,692 7/1981 Hutchinson ..... 271/164 X
4,387,889 6/1983 Koyama ..... 271/22 X

*Primary Examiner*—Richard A. Schacher
*Attorney, Agent, or Firm*—Jordan B. Bierman

[57] ABSTRACT

A sheet feeder for feeding and separating individual sheets from a stack of sheets includes a sheet feeding member mounted for sheet feeding engagement with the stack of sheets and a peeling member for preventing double-feeding of sheets. The peeling member is arranged to be movable from an operative position to an inoperative position corresponding to an insertion of the stack of sheets so as to be brought into pressure contact with the sheet feeding member in a state of the insertion of the stack of sheets.

15 Claims, 3 Drawing Figures

SHEET FEEDER

BACKGROUND OF THE INVENTION

This invention relates to a sheet feeder used in an electrostatic recording apparatus such as an electrophotographic copier and particularly to a sheet feeder having a sheet feeding member for transporting sheets and a sheet peeling member that is brought into pressure contact with the sheet feeding member so that double-feeding of sheets can be prevented.

Recently, there has been used, in high-speed type electrophotographic copiers and the like, a sheet feeder having a sheet feeding member such as a sheet feed roller for taking sheets out of a sheet cassette and a means for preventing double-feeding, or a sheet peeling member that is brought into pressure contact with the surface of the sheet feeding member so that the double-feeding of sheets can be prevented.

In this type of sheet feeders as described in U.S. Pat. No. 3,768,803, a plurality of sheets are taken out of a sheet cassette by driving the sheet feeding member and the uppermost sheet is supplied one after another by the action of the sheet peeling member. In the sheet feeder constructed as mentioned above, since several sheets remain sandwiched between the sheet feeding member and the sheet peeling member even in a non-sheet-feeding state, those sheets are sometimes left inside the copier when the sheet cassette is detached from a sheet feeding table.

SUMMARY OF THE INVENTION

It is an object of the present invention to provide a sheet feeder wherein a sheet peeling member is brought into pressure contact with a sheet feeding member upon reacting with a sheet feeding cassette to be loaded onto a sheet feeding table and such contact pressure is stable regardless of the loading state of the sheet feeding cassette, whereby the remaining of sheets inside the copier is eliminated.

The foregoing object can be obtained by the use of a means for preventing double-feeding of sheets, which is arranged to be movable from an operative position to an inoperative position corresponding to an insertion of a stack of sheets so as to be brought into pressure contact with the sheet feeding member in a state of the insertion of the stack of sheets.

DESCRIPTION OF THE DRAWINGS

FIG. 3 is an overall sectional side view of the sheet feeder showing that a sheet feeding cassette is loaded in.

DETAILED DESCRIPTION OF THE INVENTION

Figure 1:
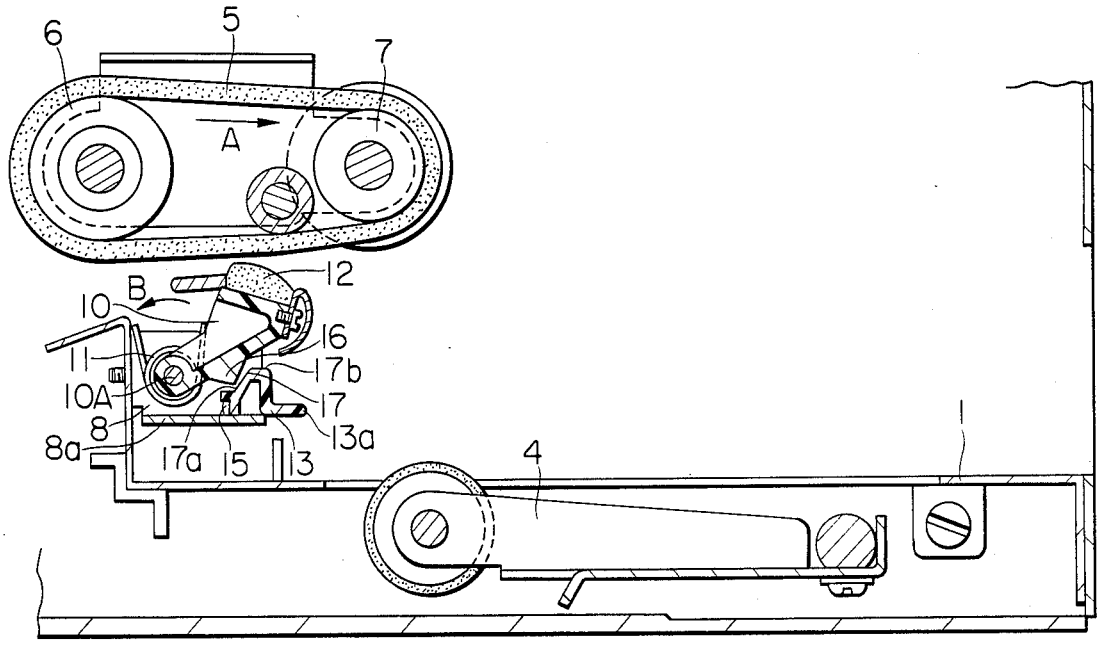
FIG. 1 is an overall sectional side view of a sheet feeder of the present invention.
Figure 3:
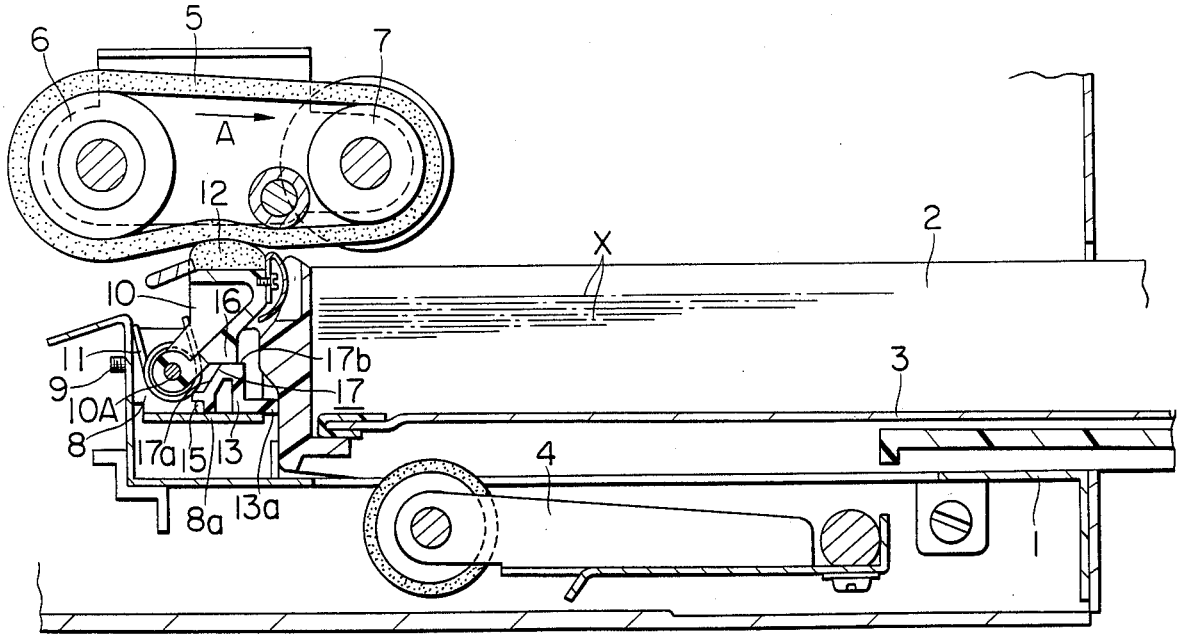

In FIG. 1, a sheet feeder for an electrophotographic copier and the like is provided with a sheet feeding table 1. The sheet feeding table 1 can be loaded, as illustrated in FIG. 3, with a sheet feeding cassette 2 stacked with a plurality of sheets X. The sheet cassette 2 is provided with a movable bottom plate 3 so that a pile of sheets X can be put on the bottom plate 3. Sheet feeding table 1 is incorporated with an elevating member 4. Every time sheets are fed, the bottom plate 3 is elevated up by the elevating member 4 toward a sheet feeding member which will be illustrated later. A sheet feeding member exemplified as an endless belt 5 is provided upper inside the sheet feeding table 1. This endless belt 5 is suspended between spaced driving pulleys 6 and 7 which align in the horizontal direction, and is driven in the direction of the arrow A as shown in FIG. 1.

The endless belt 5 is mounted for sheet feeding engagement with the edge portion of the stack of sheets, as shown in FIG. 3.

Figure 2:
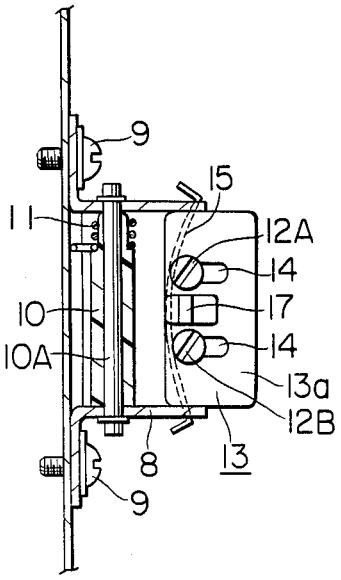
FIG. 2 is a horizontal sectional view of the substantial portion of the sheet feeder.

Underneath the belt 5, a fixing member 8 for supporting a fulcrum axis 10A horizontally is fixed by a fixing screw 9. A peeling member 10 is swingably supported by the fulcrum axis 10A and is biased in the direction opposite to the arrow B by means of a spring 11 interposingly provided between the peeling member 10 and the fixing member 8. The peeling member 10 has a friction member 12 fixed on the head portion thereof, and the friction member 12 is brought into pressure contact with the surface of the belt 5. The friction member 12 can be made of a resilient material such as natural or synthetic rubber, for example, urethane rubber, and also can be grooved as described in U.S. Pat. No. 3,768,803. The width of the friction member can be almost as wide as the width of the endless belt 5. Also, the friction member is located close to the edge portion of the stack of sheets. On the bottom wall **8*a* of the fixing member 8, there are two pieces of support pin 12A, 12B as shown in FIG. 2 and a movable operating member 13 having long holes 14 is slidably put into the support pins 12A, 12B through the long holes 14. The operating member 13 is biased in the opposite direction to the direction of insertion of the sheet feeding cassette 2 by a spring 15 interposingly mounted between the operating member 13 and the fixing member 8. One end portion 13*a* of the biased operating member 13 protrudes toward the front portion of the sheet cassette 2**.

According to the invention, a driven member 16 has a protrusive portion on the lower lateral face of the peeling member 10, and faces a cam surface 17 formed on the upper surface of the operating member 13. The cam surface 17 comprises a slant surface **17*a* with which the protrusive portion of the driven member 16 is brought into slidable contact and a positioning surface 17*b* facing in parallel with the direction of the slide of the operating member 13. That is, the positioning surface 17*b* faces almost the perpendicular direction of the pressure contact of the peeling member 10 to the endless belt 5**.

When the sheet feeding cassette 2 is inserted in the sheet feeding table 1, the front surface of the sheet cassette 2 comes into contact with one end portion **13*a* of the operating member 13 and then the operating member is pushed onward along the bottom wall 8*a* and against the force of the spring 15 as shown in FIG. 3. Accordingly, as the sheet cassette 2 is inserted, the slant surface 17*a* of the operating member 13 moves. Because of bringing the driven member 16 into slidable contact with the slant surface 17*a*, the peeling member 10 swings upward so that the friction member 12 positioned on the top of the peeling member 10 is brought into pressure contact with the surface of the belt 5, preferably in a portion between the spaced driving pulleys 6 and 7. In this instance, when the position of the driven member 16 coincides with the positioning surface 17*b* of the cam surface 17, the peeling member 10 becomes stable regardless of the sliding position of the movable member 13. Therefore, the driven member has a surface to engage with the positioning surface 17***b*. Accordingly, the pressure contact force of the friction member 12 to the belt 5 is kept constant without relation to the change of the positions where the sheet feeding cassette 2 is inserted. On the other hand, when the sheet feeding cassette 2 is removed from the sheet feeding table 1, the operating member 13 is returned to an original position by the biased spring 15 as shown in FIG. 1 and the peeling member 10 is also rotated to an inoperative position by the spring 11 in the opposite direction to the arrow B. The friction member 12 is disengaged from the belt 5 in the direction of the sheet feeding cassette, and thus, sheets remaining interposed between the peeling member 10 and the sheet feeding member are taken out in a state they are on the sheet feeding cassette 2.

What is claimed is:

1. In an apparatus for feeding and separating individual sheets from a stack of sheets comprising a sheet feeding member, mounted in said apparatus, for sheet feeding engagement with said stack and a means for preventing multiple feeding of said sheets, the improvement comprising said means being capable of assuming an operative position and an inoperative position in direct response to an insertion and removal, respectively, of said stack.

2. The apparatus of claim 1 wherein said stack is contained in a sheet feeding cassette, said means assuming an operative position in direct response to the insertion of said cassette into said apparatus and said means returning to said inoperative position in direct response to removing said cassette from said apparatus.

3. The apparatus of claim 2 wherein said means comprises a frictional surface portion which, when said means is in said operative position, is at least partially in pressure contact with said sheet feeding member.

4. The apparatus of claim 3 wherein said means comprises a moveable member directly responsive to the position of said cassette within said apparatus, said moveable member having a cam surface comprising a positioning surface substantially perpendicular to the direction of said pressure contact and a slant surface; and a driven member arranged so as to be driven by the movement of said cam surface whereby, when said cassette is inserted, said means is brought into pressure contact with said feeding member.

5. The apparatus of claim 2 wherein said feeding member comprises an endless sheet feeding belt rotatably mounted on spaced driving pulleys.

6. The apparatus of claim 3 wherein said feeding member comprises an endless sheet feeding belt rotatably mounted on spaced driving pulleys.

7. The apparatus of claim 5 wherein said means is positioned so that, in said operative position, pressure contact is made with said feeder belt at a point between said spaced pulleys.

8. The apparatus of claim 6 wherein said means is positioned so that, in said operative position, pressure contact is made with said feeder belt at a point between said spaced pulleys.

9. The apparatus of claim 4 wherein said driven member comprises a surface to engage said positioning surface of said cam.

10. The apparatus of claim 4 wherein said driven member comprises a protrusive portion arranged so as to be brought into slideable contact with said slant surface of said cam.

11. The apparatus of claim 9 wherein said driven member comprises a protrusive portion arranged so as to be brought into slideable contact with said slant surface of said cam.

12. The apparatus of claim 4 wherein said moveable member further comprises an edge portion extending from said moveable member in a direction which is opposite to an insertion direction of said cassette.

13. The apparatus of claim 4 wherein said moveable member is biased in a direction which is opposite to an insertion direction of said cassette.

14. The apparatus of claim 5 wherein said stack has an edge portion and said feeding belt is mounted so as to engage said edge portion.

15. The apparatus of claim 4 wherein said moveable member is pivotably mounted so that, on insertion of said cassette, said means rotates about said pivot and brings said frictional surface portion of said means into pressure contact with said sheet feeding member.

* * * * *